United States Patent [19]

Gruber et al.

[11] Patent Number: 4,461,193

[45] Date of Patent: Jul. 24, 1984

[54] HANDLING PLIERS

[76] Inventors: Alexandre Gruber; Anne B. Gruber, both of 23, Blvd. Pasteur, 51100 Reims, France

[21] Appl. No.: 293,624

[22] PCT Filed: Dec. 16, 1980

[86] PCT No.: PCT/FR80/00182

§ 371 Date: Aug. 6, 1981

§ 102(e) Date: Aug. 6, 1981

[87] PCT Pub. No.: WO81/01814

PCT Pub. Date: Jul. 9, 1981

[30] Foreign Application Priority Data

Dec. 21, 1979 [FR] France ..... 79 31635

[51] Int. Cl.[3] ..... B25B 7/02

[52] U.S. Cl. ..... 81/420; 81/302; 294/16

[58] Field of Search ..... 81/420, 302; 294/28, 294/16, 18, 25

[56] References Cited

U.S. PATENT DOCUMENTS 3,410,592 11/1968 Schweizer ..... 294/16

3,558,169 1/1971 Onanian ..... 294/16

FOREIGN PATENT DOCUMENTS 1012132 4/1952 France ..... 81/302

2393653 2/1979 France ..... 294/16

1363370 8/1974 United Kingdom .

*Primary Examiner*—James L. Jones, Jr.

*Attorney, Agent, or Firm*—Lerner, David, Littenberg, Krumholz & Mentlik

[57] ABSTRACT

A pliers for handling disks and other flat and thin objects. The pliers are substantially comprised of jaws (4) provided with claws (5), biased against each other by an adjustable tension spring (3), arranged between the arms (1). The jaws (4) are made into a single part, of flexible material, and folded in two portions to form a hinge (6) acting as a penetration limiter, distinct from that (2) of the arms (1). The claws (5) are fixed on the jaws (4) by a turned down edge (10) thicker than the protuberance (12) located at the junction of the arms (1) with the jaws (4). The ends of the claws (5) are tapered and offset so as to facilitate the insertion of the jaws (4) between the object and the handling of the object with the pliers.

12 Claims, 2 Drawing Figures

HANDLING PLIERS

The invention relates to pliers for handling disks and other flat and thin objects, subject to scratching, pollution, contamination, or of which repeated handling presents certain risks for the fingers.

The handling of gramophone or video disks, photographic plates, printed circuits, silicon plates used for the manufacture of photovoltaic cells, microfiches, sterile or, on the contrary, contaminated objects, requires considerable precautions with a view to reducing, depending on the case, the risks of deterioration by a scratching or soiling, pollution or contamination.

Long-playing or video disks, at present proposed on the market, have become high-precision products capable of restoring sounds or images with high fidelity and a minimum of alteration. The quality of this restitution depends, of course, on the integrity and cleanliness of the disks, which obliges the users to take considerable precautions when gripping and handling, in order to avoid scratches by the finger-nails, rings or bracelets and any soiling by the fingers, as the scratches and soiling are respectively translated by "taps" and "crackling" which disturb hearing.

In the electronic, photographic and printing fields, it is mainly pollution by the acid substance secreted by the fingers which it is sought to avoid for reasons of corrosion or disturbance of the subsequent treatments.

In the biological and medical fields, the risks of bacteriological and microbial contamination, during manipulations or analyses must be eliminated. Now, the fingers, particularly at nail level, are capable of transmitting this contamination.

In the nuclear field, it is the handling of objects contaminated by radioactive particles, during decontamination operations, which exposes the operators to certain risks.

In other domains, it is the repeated handling of very rough objects such as grinding wheel disks, for example, or sheets of abrasives, which causes wear and irritation of the epidermis at the end of the fingers.

For these handlings, gloves or pliers, specially designed for these different uses, are already used.

In particular, pliers for handling disks, corresponding to the preamble of claim 1 are known (patents: French A 2 040 678 and A 2 393 653; U.S. Pat. No. 1,365,227; Belgian A 555 159; British A 1 363 773). It is respectively question of pliers: with curved noses, which enables the disk to be gripped by its edge outside the recorded surface; with flat noses covered with plastics material, which enables the disk to be gripped in the recorded zone; with long, flat noses, whose end is provided with buffers enabling the disk to be gripped by its central, non-recorded part; with flexible noses, of the tweezer type, enabling the disk to be gripped in the recorded zone; and made of flexible material of which the hinge is obtained by simple folding.

The pliers with curved noses, which enables the disk to be gripped by its edge outside the recorded surface, must be used with precaution, as a somewhat sudden handling could provoke a deformation, and even a breakage, of the edge. The pliers with flat noses covered with plastics material are equipped with arms of the scissor type, which obliges a pressure to be maintained with two fingers during the whole duration of the handling. All these pliers, with the exception of those of the tweezer type, require that a constant pressure of the hand be maintained for the whole duration of the handling, including when the side is changed, which imposes relaying this pressure with the aid of the other hand, to avoid an awkward rotation of the wrist, when turning over.

None of these pliers are equipped with a precise and permanent adjustment of the pressure exerted by the jaws, as a function of the thickness, weight and dimensions of the disk, and none have been designed to facilitate insertion of the noses in the record sleeve, nor to avoid scratching the adjacent disks with the back of the noses. The jaws are not applied against each other in rest position, this promoting the deposit of abrasive dust on their working surface.

The present invention has for its object to remedy these drawbacks. The pliers, object of the invention, as characterised in the claims, is mainly distinguished in that the jaws are biased against each other, by an adjustable tension spring; the claws, made of flexible material, are connected together by an elastic hinge serving to limit penetration between the jaws of the object to be handled; in that it is provided with devices facilitating insertion of the jaws between the objects and protecting the superposed or juxtaposed adjacent objects.

The advantages obtained due to this invention consist essentially in that the clamping force of the jaws of the pliers is adjustable as a function of the nature, thickness and weight of the object to be handled; the object may be turned over simply by rotating the arms of the pliers in the palm of the hand; the penetration of the object between the jaws is limited so as to eliminate any risk of gripping the object at hinge level; the penetration of the jaws between juxtaposed objects is facilitated; any risk of scratching the adjacent objects is eliminated; the dust cannot lay on the inner face of the claws, during periods of non-use, since they are then applied against each other.

Other characteristics and advantages of the invention will appear in the following description of a particular embodiment, given by way of example, illustrated by drawings, in which.

Figure 1:
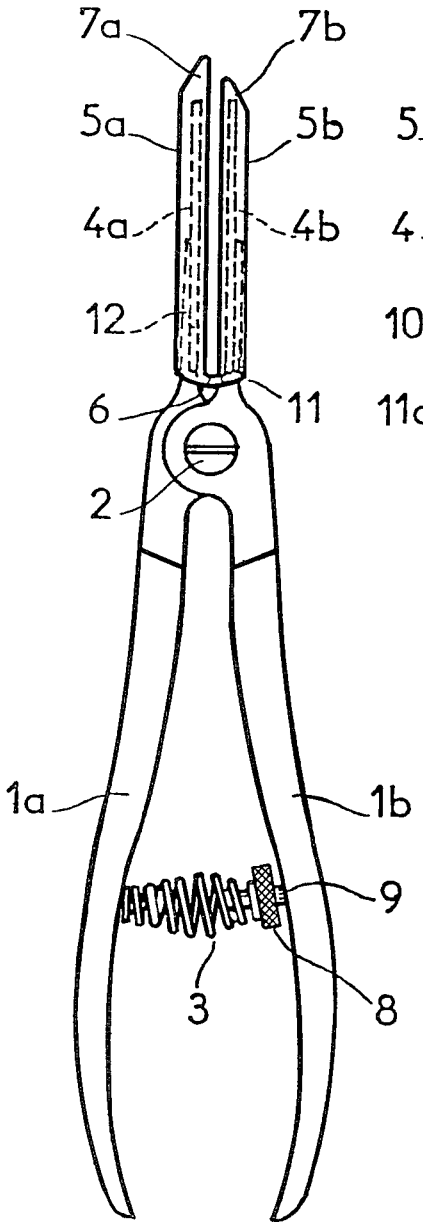
FIG. 1 shows a side view of the pliers made according to the present invention.
Figure 2:
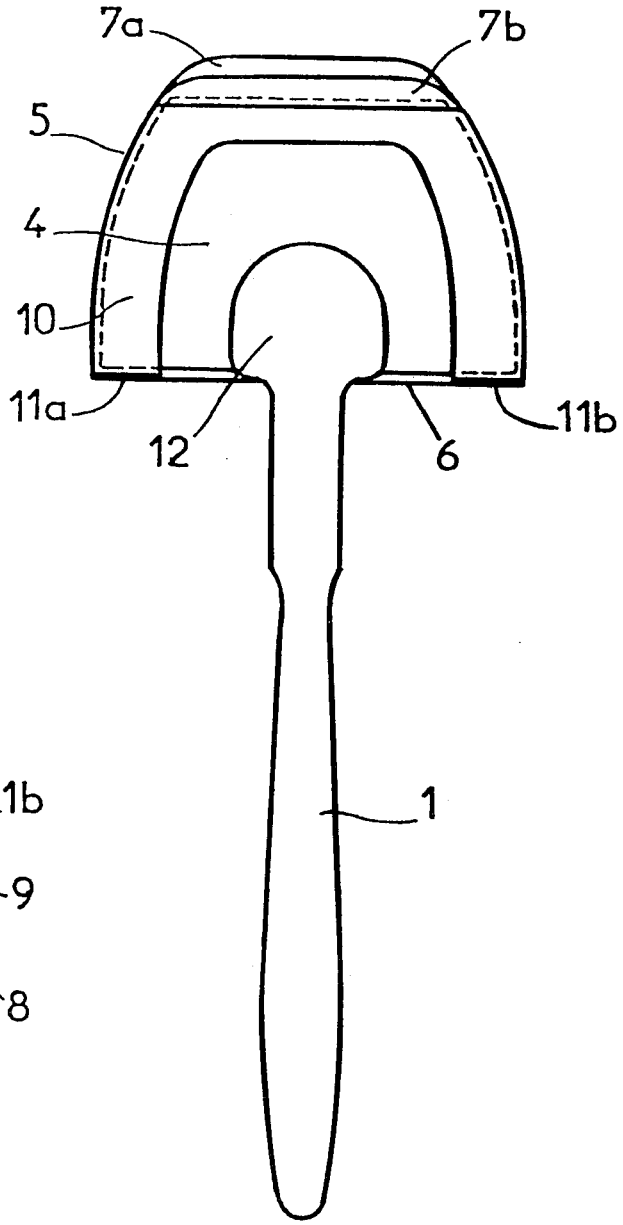
FIG. 2 shows a front view of the pliers equipped with its claws.

The Figures show pliers for handling gramophone disks and other flat and thin objects, essentially comprising two arms 1 articulated about the pivot pin 2, subjected to a spacing apart force produced by a spring 3 whose tension is adjustable by a knurled nut 8, mounted on a threaded pin 9 fast with one of the arms, extended by the jaws 4 on which are mounted the claws 5, connected and hinged to each other by the fold 6 forming penetration limiter; the claws 5 are retained against the inner face of the jaws 4 by a turned down edge 10, welded over its whole width, at the level of the fold of articulation 6, by beads 11; the claws each possess a tapered part 7, at their end; the arms 1 are connected to the jaws 4 by an enlargement 12 not having a sharpe edge, whose thickness is smaller than that of the turned down edge 10.

According to the present invention, the jaws 4*a* and 4*b*, provided with their claws 5*a* and 5*b*, are permanently biased against each other by the spring 3, mounted between the arms 1*a* and 1*b*, so as to exert a sufficient force for clamping the object and for immobilising it with respect to the pliers; when the object is thus held, it may easily be handled or turned over by simple displacement of the pliers or rotation thereof in the hand. The clamping force of the jaws 4 may be precisely adjusted as a function of the thickness, the weight and dimensions of the object, by acting on the knurled nut 8. During positioning of the pliers on the object, the tapered ends 7*a* and 7*b* facilitate insertion of the jaws in the record sleeves, between juxtaposed objects or between an object and its support.

According to a preferred embodiment of the invention, one of the tapered ends 7*b* is slightly recessed with respect to the end 7*a* of the other claw, so as to facilitate the presentation of the pliers on the edge of the object to be handled, then the insertion thereof between the jaws. The presence of a penetration limiter 6 distinct from the pivot pin 2 allows a rapid positioning on the object, without particular precaution, since the edge of the object does not risk any deterioration and the adjacent objects are protected from any scratching by the turned down edge 10, of which the thickness is determined so as to eliminate any risk of contact with the enlargement 12 ensuring connection between the arms and the jaws. The claws 5 being made in a single part, of a flexible material, then returned against each other to form a hinge fold 6, this fold, although located well in front of the pivot pin 2, is fairly elastic to allow a sufficient opening of the pliers when an effort of approach is exerted on the arm 1. This design further offers the advantage of allowing a perfect contact of the claws against each other, under the action of the spring 3; this eliminates any risk of deposit of dust or other pollution during periods of non-use. The claws 5 may easily be positioned on the jaws 4, due to the elasticity of the turned down edges 10, despite the presence of the beads 11*a* and 11*b*, which then oppose any slide of the claws 5 with respect to the jaws 4.

The pliers, object of the invention, may be used in all cases where the handling of flat and thin objects requires considerable precautions and more particularly, when these objects are very sensitive to scratches, pollution or contamination, or when their repeated handling presents certain risks for the fingers. It may be used in the domains of audio-visual, electronics, photography, biology and nuclear.

A particularly interesting application exists in the handling of gramophone and video disks.

I claim:

1. A pliers for handling flat and thin objects comprising:

first and second plier elements each having a handle portion and a substantially flat jaw portion, said first and second plier elements being pivotally joined so that the respective substantially flat jaw portions thereof can mate when in a closed position; and a flexible claw assembly including first and second claws joined together by a hinge, said first and second claws being configured, respectively, to be carried by and to be disposed between said substantially flat jaw portions of said first and second plier elements, said hinge being disposed adjacent to said pivotal joining of said first and second plier elements when said first flexible claw assembly is positioned on said plier elements, said hinge serving as a stop to limit the distance an object can be inserted between said substantially flat jaw portions, said flexible claw assembly being fixed in position on the jaw portions of said first and second plier elements by a turned down edge disposed on the outer face of said first and second claws.

2. A pliers in accordance with claim 1, wherein said flexible claw assembly and said hinge thereof is made in a single part of a flexible material.

3. A pliers in accordance with claim 1, wherein said turned down edge of said first and second claws are joined to the respective said claws over their whole width at the level of the fold of said hinge.

4. A pliers in accordance with claim 1, wherein said turned down edge has a thickness which is greater than the height of the junction between said handle portions and said jaw portions of each of first and second plier elements.

5. A pliers in accordance with claim 1, further comprising biasing means for biasing said jaw portions toward each other.

6. A pliers in accordance with claim 5, wherein said biasing means includes a spring assembly of adjustable tension serving to bias said flat jaw portions toward each other, said biasing means being disposed between said handle portions of said first and second plier elements.

7. A pliers in accordance with claim 5, wherein said spring assembly comprises a knurled nut threadably mounted on a threaded pin fixedly secured to said handle portion of said first plier element, and a compression spring coaxially disposed partially over said threaded pin, one end of said compression spring being adjacent to said knurled nut, the other end thereof being secured to said handle portion of said second plier element.

8. A pliers in accordance with claim 1, wherein the ends of said flat jaw portions are tapered to facilitate the insertion thereof between the objects to be handled or between an object or object to be handled and a support.

9. A pliers in accordance with claim 8, wherein the ends of said flat jaw portions are longitudinally offset.

10. A pliers in accordance with claim 1, wherein the ends of said flat jaw portions are longitudinally offset.

11. A pliers in accordance with claim 1, wherein said handle portions are enlarged at the portion of their junction with their respective said jaw portions so as to provide no sharp edges.

12. A pliers in accordance with claim 1, wherein said first and second claws are completely applied against each other when in a rest position.

* * * * *